US005415975A

United States Patent [19]

Cotner

[11] Patent Number: 5,415,975

[45] Date of Patent: May 16, 1995

[54] CONTRAST-PROMOTING AGENTS IN GRAPHIC ARTS MEDIA

[75] Inventor: Richard C. Cotner, Stillwater, Minn.

[73] Assignee: Minnesota Mining and Manufacturing Company, St. Paul, Minn.

[21] Appl. No.: 248,358

[22] Filed: May 24, 1994

[51] Int. Cl.[6] ..... G03C 1/06

[52] U.S. Cl. ..... 430/264; 430/598; 430/600; 430/613

[58] Field of Search ..... 430/264, 598, 600, 613

[56] References Cited

U.S. PATENT DOCUMENTS

| | | | |
|---|---|---|---|
| 2,857,276 | 10/1958 | Land et al. | 430/250 |
| 3,287,135 | 11/1966 | Anderson et al. | 430/533 |
| 3,579,348 | 5/1971 | Fix et al. | 430/569 |
| 4,229,526 | 10/1980 | Ohlschlager | 430/583 |
| 4,297,430 | 10/1981 | Kanada et al. | 430/204 |
| 4,331,444 | 5/1982 | Mihara et al. | 436/539 |
| 4,358,528 | 11/1982 | Takagi et al. | 430/598 |
| 4,693,956 | 9/1987 | Marchesano | 430/264 |
| 4,798,780 | 1/1989 | Hall et al. | 430/264 |
| 4,983,489 | 1/1991 | Yamada et al. | 430/264 |
| 4,992,352 | 2/1991 | Nakamura | 430/264 |
| 5,275,932 | 1/1994 | Weigel et al. | 430/617 |

FOREIGN PATENT DOCUMENTS

| | | |
|---|---|---|
| 0420005A1 | 9/1990 | European Pat. Off. . |
| 1204964 | 9/1970 | United Kingdom . |

*Primary Examiner*—Thomas R. Neville

*Attorney, Agent, or Firm*—Gary L. Griswold; Walter N. Kirn; Mark A. Litman

[57] ABSTRACT

A silver halide photographic emulsion comprising a hydrophilic colloid binder, negative-acting silver halide grains, a hydrazine, and a contrast-promoting amount of a compound selected from the group consisting of 3-indazolinones, 4(3H)-pyrimidones, urazoles, 2-pyrazolin-5-ones, and 3-pyrazolin-5-ones.

16 Claims, No Drawings

CONTRAST-PROMOTING AGENTS IN GRAPHIC ARTS MEDIA

FIELD OF THE INVENTION

This invention relates to black and white photographic elements, particularly to negative acting graphic arts films, and more particularly to negative acting hybrid (high contrast, hydrazine activated) graphic art films. This invention describes negative acting hybrid graphic art films incorporating classes of compounds selected from 3-indazolinones, 4(3H)-pyrimidones, urazoles, 3-pyrazolin-5-ones and 2-pyrazolin-5-ones as a contrast-promoting agent.

BACKGROUND OF THE INVENTION

High contrast negatives for line and half-tone work are important in the practice of the graphic arts. Development of such films is carried out for maximum contrast in special developers which are known in the art as 'lith' developers. In conventional lith developers, high contrast is achieved using the lithographic effect, (also referred to as infectious development) as described by Yule in the *Journal of the Franklin Institute,* 239, 221–230. This type of development is believed to proceed autocatalytically. To achieve the lith effect in development, a low, but critical concentration of free sulfite ion is maintained by using an aldehyde bisulfite adduct, such as sodium formaldehyde bisulfite, which acts as a sulfite ion buffer. The low sulfite ion concentration is necessary to avoid interference with the accumulation of developing agent oxidation products. Such interference can result in the prevention or at least treduction of infectious development. The developer typically contains only a single type of developing agent, namely, a developing agent of the dihydroxybenzene type, such as hydroquinone.

Conventional lith developers suffer from serious deficiencies which restrict their usefulness. For example, the developers tend to exhibit low capacity because it contains only hydroquinone as the developing agent. Also, the aldehyde tends to react with the hydroquinone to cause undesirable changes in development activity. Furthermore, the low sulfite ion concentration is inadequate to provide effective protection against aerial oxidation. As a result, conventional lith developers lack stability and tend to give erratic results depending on the length of time that they have been exposed to the air.

An alternative to the use of conventional lith developers is disclosed in Nothnagle, U.S. Pat. No. 4,269,929, 'High Contrast Development Of Photographic Elements'. As described in this patent, high contrast development of photographic elements is carried out in the presence of a hydrazine compound with an aqueous alkaline developing solution which has a pH of above 10 and below 12 and contains a dihydroxybenzene developing agent, a 3-pyrazolidone developing agent, a sulfite preservative, and as a contrast-promoting agent, an amino compound. U.S. Pat. No. 4,269,929 describes the use of a very wide variety of amino compounds as contrast-promoting agents. In particular, it discloses the use of both inorganic amines, such as the hydroxylamines, and organic amines, including aliphatic amines, aromatic amines, cyclic amines, mixed aliphatic-aromatic amines, and heterocyclic amines. Primary, secondary and tertiary amines, as well as quaternary ammonium compounds, are included within the broad scope of the disclosure.

High contrast developing compositions which contain amino compounds as contrast-promoting agents which are intended for carrying out development in the presence of a hydrazine compound are also disclosed in U.S. Pat. Nos. 4,668,605 and 4,740,452. U.S. Pat. No. 4,668,605 describes developing compositions containing a dihydroxybenzene, a p-aminophenol, a sulfite, a contrast-promoting amount of an alkanolamine comprising an hydroxyalkyl group of 2 to 10 carbon atoms, and a mercapto compound. The developing compositions of U.S. Pat. No. 4,740,452 contain a contrast-promoting amount of certain trialkyl amines, monoalkyldialkanolamines or dialkylmonoalkanol amines.

The inherent disadvantages of incorporating amino compounds as contrast-promoting agents in developing compositions have been recognized in the prior art, and proposals have been made to overcome these disadvantages and other problems by incorporating the amino compound into the photographic element. In particular, the use of amino compounds as incorporated boosters has been proposed in Japanese Patent Publication Nos. 140340/85 and 222241/87. In Publication No. 140340/85, it is alleged that any amino compound can be utilized as an 'incorporated booster,' while Publication No. 222241/87 is directed to the use of amino compounds defined by a specific structural formula as incorporated boosters. Publication No. 222241/87 points to some of the problems involved in following the teachings of Publication No. 140340/85, including generation of 'pepper fog'.

A photographic system depending on the conjoint action of hydrazine compounds which function as nucleators, and amino compounds which function as contrast-promoting agents is an exceedingly complex system. It is influenced by both the composition and concentration of the nucleator and contrast-promoting agent and by many other factors, including the pH and composition of the developer, and the time and temperature of development. The goals of such a system include the provision of enhanced contrast, together with excellent dot quality and low pepper fog.

U.S. Pat. No. 4,237,214, Mifune et al, describes a lith system utilizing heterocyclic quaternary salts in addition to arylacylhydrazine.

British Patent 1,581,963, claims increased speed and contrast when thioamide compounds, such as benzothiazolinethione, are present in addition to the hydrazide.

U.S. Pat. No. 4,241,164, Mifune et al, claims increased sensitivity when the hydrazide emulsion contains hydroxytetraazaindene.

U.S. Pat. No. 4,269,929, Nothnagle, describes a system using a hydrazine and a contrast-promoting amount of an alkylamine or alkanolamine.

U.S. Pat. No. 4,914,003, Yagihara et al, describes a system using a hydrazine and a amine compound of general formula:

$$\overset{(R^2)_2}{\overset{|}{N}}-A-(X)_n-R^1$$

U.S. Pat. No. 4,975,354, Machonkin et al, describes a system using a hydrazine and certain secondary and tertiary amino compounds of general formula:

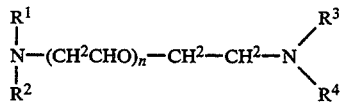

U.S. Pat. No. 3,043,694, Barr et al, describes 3-indazolinone as a developing agent in a photographic developer solution.

EPO 0 324 391, Takamuki, describes a high contrast processing method for silver halide emulsions where 3-pyrazolidone and di- or trihydroxybenzene compounds are in a developer containing a di- or trihydroxybenzene compound, sulfite, and an amino compound in the presence of a hydrazide.

U.S. Pat. No. 5,139,921, Takagi, describes a process of forming a high contrast image with a silver halide material containing a hydrazide and a nucleation accelerator (an amino containing mercaptan, mercaptotetrazole, oxazole, oxadiazole, triazole, imidazole, thiadiazole, diazole, triazolopyrimide, or purines) in a developer of pH 9.6 to 11.0.

U.S. Pat. No. 4,937,160 discloses amino bosters for hydrazide containing hybrid graphic arts emulsions.

SUMMARY OF THE INVENTION

The present invention describes an alternative group of contrast-promoting agents selected from the group consisting of 3-indazolinones, urazoles, 2-pyrazolin-5-ones, 3-pyrazolin-5-ones and 4(3H)-pyrimidones which may be employed in silver halide emulsions in conjoint action with contrast-promoting hydrazine compounds to provide increased contrast (especially toe contrast, mid-tone contrast, and shoulder contrast), and maximum optical density with low pepper fog.

DETAILED DESCRIPTION OF THE INVENTION

This invention provides novel silver halide photographic elements which contain, in at least one layer of the element, a compound selected from amongst 3-indazolinones, urazoles, 2-pyrazolin-5-ones, 3-pyrazolin-5-ones and 4(3H)-pyrimidones as contrast-promoting agents. These elements are developed in the presence of a hydrazine compound. The hydrazine compound is preferably incorporated within one or more layers of the photographic element.

Included within the scope of the 3-indazolinones utilized as contrast-promoting agents in this invention are compounds having the central nucleus:

3-indazolinone:

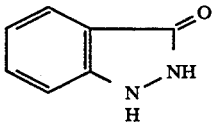

or in general:

-continued

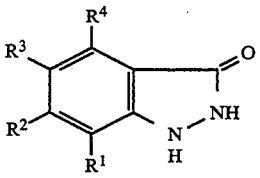

in which $R^1$, $R^2$, $R^3$, and $R^4$ are hydrogen atoms, alkyl groups, substituted alkyl groups, aryl groups, alkoxyphenyl groups, heterocyclic groups, halogen atoms, carbamyl groups, alkcarbonyl groups, alkoxycarbonyl groups, amino groups, and substituted amino groups.

In the photographic and graphics art field, substitution of compounds is common and often desirable. In defining the substituent groups, the generic cyclic groups, and the common nucleus of the 3-indazolinones, urazoles, 2- and 3-pyrazolin-5-ones, and pyrimidones the possibility of substitution is contemplated in the use of the term "group" to define a substituent. For example, the term 'alkyl group' allows for the unsubstituted alkyl (e.g., methyl, ethyl, propyl, hexyl, iso-octyl, etc.) as well as photographically conventionally substituted alkyl (e.g., monochloromethyl, hydroxyethyl, cyanopropyl, 1,2,3,4-tertabromobutyl, alkyl ethers, 6-carbonylhexyl, etc.). The term 'alkyl' or 'alkyl moiety' represents an unsubstituted alkyl group. Where a class of compounds is defined by a formula representing a "central nucleus," any compound having the defined central nucleus, irrespective of the degree of substitution, is intended by the inventors to be included within the scope of the formula. As long as the substitution does not alter fundamental aspects of the structure (e.g., converting a divalent bond to a single bond), any compound containing the defined central nucleus is contemplated by the inventors as performing in its capacity within the scope of the present invention.

Using the basic construction of commercially available high contrast graphic arts film such as 3M Excelerate TM graphic arts film (a hybrid graphic arts film), incorporating 3-indazolinone or the other generic cyclic materials as an ingredient in the finaling of the emulsion yields a film with increased toe contrast, mid-tone contrast, shoulder contrast, and Dmax with low pepper fog levels.

A preferred silver halide photographic light sensitive emulsion as taught in U.S. Pat. No. 4,798,780 contains a hydrazine of the general formula $$R^3—NR^4—NR^5—G—X$$

in which:

$R^3$ represents an aryl group, one of $R^4$ and $R^5$ is a hydrogen and the other is selected from hydrogen, aryl sulfonyl and trifluoroacetyl, G represents carbonyl, sulfonyl, sulfoxy, phosphoryl or an N-substituted or unsubstituted imino group and X is a moiety such that at a pH in the range of 9.5 to 12.5 in the presence of an oxidized hydroquinone a cyclization reaction takes place cleaving the moiety —G—X from the remainder of the molecule and forming a cyclic structure comprising atoms of the moiety —G—X.

EXAMPLES

The following examples further illustrate this invention.

A silver halide emulsion with a bromide:chloride:iodide ratio of 68:30:2 was prepared by conventional double jet techniques. Conditions were chosen so that an emulsion with a narrow grain size distribution was obtained having an average grain size of 0.2 micron. The emulsion was coagulated and washed in the conventional manner and reconstituted to give a silver ratio of 93 g gelatin per mole of silver. The emulsion was chemically sulfur sensitized.

The emulsion was coated onto polyester base at a silver coating weight of 4.3 g/m2 with the following additions: wetting agent (Hostapur TM), a polyethylene oxide (Brij 58), a sensitizing dye (5-(5-methoxy-3-(4-sulfobutyl)-2-(3H) benzothiazolylidene) -4-oxo-3- (2-hydroxyethyl)-2-thioxothiazolidene), a contrast promoting agent (benzhydrol), a hydrazide derivative (1-(21-hydroxymethylbenzoyl)-2-phenyl hydrazine), ascorbic acid, colloidal silica (Ludox TM), 3-indazolinone, and a hardener (2-hydroxy-b-4,6-dichloro-1,3,5-triazine).

A topcoat was applied comprising 60 g of gelatin per 1000 g water, wetting agent, matting agent (silica), surfactant (FC170C, 3M), polyethylene (Slip-Ayd TM), an acrylic latex (Rhoplex TM), and a hardener (2-hydroxy-b-4,6-dichloro-1,3,5-triazine).

The following samples were individually exposed in an argon ion laser sensitometer which was attenuated by a 0 to 3 continuous neutral density wedge in contact with the coating. The coatings were developed for 35 seconds at 95° F. in 3M Excelerate TM developer (a hydroquoinone developer, pH 11.4, commercially available from 3M).

| Cmpd | Amount M/M Ag | Dmin | Dmax | Toe Gamma | Mid Gamma | Shldr Gamma | Rel. Speed | Peppr count |
|---|---|---|---|---|---|---|---|---|
| — | | 0.040 | 4.51 | 1.97 | 10.94 | 3.53 | .77 | 28 |
| 1 | 0.0047 | 0.038 | 4.73 | 2.15 | 13.18 | 5.10 | .83 | |
| 1 | 0.0093 | 0.038 | 4.97 | 2.40 | 16.35 | 8.23 | .88 | 16 |
| 1 | 0.0187 | 0.038 | 5.08 | 2.75 | 17.15 | 10.35 | .91 | |

Compound 1 is 3-indazolinone.

| Cmpd | Amount M/M Ag | Dmin | Dmax | Toe Gamma | Mid Gamma | Shldr Gamma | Rel. Speed | Peppr count |
|---|---|---|---|---|---|---|---|---|
| — | | 0.026 | 4.83 | 3.05 | 14.52 | 5.47 | 1.00 | 28 |
| 2 | 0.0032 | 0.025 | 4.96 | 3.07 | 15.60 | 7.24 | 1.02 | 11 |
| 3 | 0.0037 | 0.024 | 4.84 | 2.98 | 15.01 | 5.75 | 0.95 | 8 |

Compound 2 is 5,6-dimethoxy-3-indazolinone.
Compound 3 is 6-chloro-3-indazolinone.

The compounds of the invention also exhibited very high dot quality and low pepper fog levels.

The following samples were similarly prepared and exposed. The coatings were developed for 60 seconds at 110° F. in 3M RPD developer, a rapid access developer (a hydroquoinone developer, pH 10.4) commercially available from 3M).

| Cmpd | Amount M/M Ag | Dmin | Dmax | Toe Gamma | Mid Gamma | Shldr Gamma | Rel. Speed |
|---|---|---|---|---|---|---|---|
| — | | 0.02 | 4.77 | 0.96 | 7.63 | 3.39 | .73 |
| 1 | 0.0093 | 0.02 | 5.22 | 1.16 | 12.99 | 8.66 | .86 |

The following samples were individually exposed in an argon-ion laser sensitometer which was attenuated by a 0 to 3 continuous neutral density wedge in contact with the coating. The coatings were developed for 35 seconds at 95° F. in 3M Excelerate developer (a hydroquoinone developer, pH 11.4, commercially available from 3M).

| Cmpd | Amount M/M Ag | Dmin | Dmax | Toe Gamma | Mid Gamma | Shldr Gamma | Rel. Speed |
|---|---|---|---|---|---|---|---|
| — | | 0.02 | 4.90 | 2.53 | 13.97 | 5.54 | 1.00 |
| 5 | 0.0033 | 0.02 | 5.01 | 2.63 | 15.23 | 7.14 | 1.04 |
| 5 | 0.0065 | 0.02 | 5.05 | 2.71 | 16.56 | 8.08 | 1.06 |
| 5 | 0.0130 | 0.02 | 5.18 | 2.70 | 16.94 | 11.13 | 1.05 |
| 5 | 0.0260 | 0.02 | 5.27 | 2.89 | 18.67 | 14.83 | 1.05 |
| 5 | 0.0520 | 0.03 | 5.30 | 3.58 | 20.40 | 20.26 | 1.01 |

Compound 5 is 4(3H)-pyrimidone

The compounds of the invention also exhibited very high dot quality and low pepper fog levels.

The following samples were similarly prepared and exposed. The coatings were developed for 60 seconds at 100 F. in 3M RPD developer, a rapid access developer (a hydroquoinone developer, pH 10.4, commercially available from 3M).

| Cmpd | Amount M/M Ag | Dmin | Dmax | Toe Gamma | Mid Gamma | Shldr Gamma | Rel. Speed |
|---|---|---|---|---|---|---|---|
| — | | 0.02 | 4.19 | 0.79 | 4.40 | 3.08 | .22 |

-continued

| Cmpd | Amount M/M Ag | Dmin | Dmax | Toe Gamma | Mid Gamma | Shldr Gamma | Rel. Speed |
|---|---|---|---|---|---|---|---|
| 5 | 0.0520 | 0.03 | 4.47 | 2.02 | 7.52 | 4.11 | .38 |

The following samples were individually exposed in an argon-ion laser sensitometer which was attenuated by a 0 to 3 continuous neutral density wedge in contact with the coating. The coatings were developed for 35 seconds at 95 F. in 3M Excelerate developer.

| Cmpd | Amount M/M Ag | Dmin | Dmax | Toe Gamma | Mid Gamma | Shldr Gamma | Rel. Speed |
|---|---|---|---|---|---|---|---|
| — | | 0.03 | 4.92 | 2.83 | 15.39 | 7.00 | .98 |
| 7 | 0.0031 | 0.03 | 4.99 | 3.04 | 16.81 | 8.78 | 1.00 |
| 7 | 0.0062 | 0.03 | 5.00 | 3.04 | 16.69 | 10.36 | 1.00 |
| 7 | 0.0124 | 0.03 | 5.07 | 3.14 | 17.14 | 9.79 | 1.01 |
| 7 | 0.0247 | 0.03 | 5.07 | 3.25 | 18.32 | 12.83 | 1.02 |
| 7 | 0.0495 | 0.02 | 5.18 | 2.99 | 20.26 | 24.11 | 1.09 |

Compound 7 is urazole.

| Cmpd | Amount M/M Ag | Dmin | Dmax | Toe Gamma | Mid Gamma | Shldr Gamma | Rel. Speed |
|---|---|---|---|---|---|---|---|
| — | | 0.02 | 4.73 | 2.86 | 13.51 | 4.48 | 0.94 |
| 8 | 0.0027 | 0.02 | 4.71 | 3.03 | 14.37 | 4.51 | 0.96 |
| 8 | 0.0054 | 0.02 | 4.88 | 3.09 | 16.12 | 7.19 | 0.98 |
| 8 | 0.0109 | 0.02 | 4.99 | 3.13 | 16.97 | 8.53 | 1.00 |
| 8 | 0.0217 | 0.02 | 5.26 | 3.58 | 21.93 | 23.69 | 1.07 |
| 8 | 0.0434 | 0.03 | 5.21 | 3.31 | 22.41 | 30.52 | 1.10 |

Compound 8 is 4-methyl urazole.

| Cmpd | Amount M/M Ag | Dmin | Dmax | Toe Gamma | Mid Gamma | Shldr Gamma | Rel. Speed |
|---|---|---|---|---|---|---|---|
| — | | 0.03 | 4.95 | 3.23 | 15.91 | 7.26 | 1.01 |
| 9 | 0.0027 | 0.03 | 4.98 | 3.31 | 16.96 | 8.89 | 1.03 |
| 9 | 0.0054 | 0.03 | 5.01 | 3.33 | 16.90 | 8.74 | 1.03 |
| 9 | 0.0109 | 0.03 | 5.09 | 3.37 | 16.98 | 11.98 | 1.02 |
| 9 | 0.0217 | 0.03 | 5.25 | 3.38 | 19.46 | 15.91 | 1.06 |
| 9 | 0.0434 | 0.03 | 5.22 | 3.71 | 21.63 | 22.21 | 1.09 |

Compound 9 is 4-phenyl urazole.

The compounds of the invention also exhibited very high dot quality and low pepper fog levels.

The following samples were similarly prepared and exposed. The coatings were developed for 60 seconds at 100 F. in 3M RPD developer.

| Cmpd | Amount M/M Ag | Dmin | Dmax | Toe Gamma | Mid Gamma | Shldr Gamma | Rel. Speed |
|---|---|---|---|---|---|---|---|
| — | | 0.02 | 4.28 | 0.83 | 3.80 | 3.21 | .15 |
| 8 | 0.0217 | 0.02 | 4.51 | 0.90 | 6.90 | 3.29 | .42 |

The following samples were individually exposed in an argon-ion laser sensitometer which was attenuated by a 0 to 3 continuous neutral density wedge in contact with the coating. The coatings were developed for 35 seconds at 95 F. in 3M Excelerate developer.

| Cmpd | Amount M/M Ag | Dmin | Dmax | Toe Gamma | Mid Gamma | Shldr Gamma | Rel. Speed |
|---|---|---|---|---|---|---|---|
| — | | 0.03 | 4.88 | 3.20 | 15.43 | 5.67 | 1.01 |
| 10 | 0.0032 | 0.02 | 4.92 | 3.20 | 15.41 | 5.86 | 1.03 |
| 10 | 0.0064 | 0.02 | 4.92 | 3.26 | 15.80 | 7.03 | 1.05 |
| 10 | 0.0127 | 0.02 | 5.14 | 3.34 | 19.71 | 12.20 | 1.09 |
| 10 | 0.0255 | 0.02 | 5.21 | 3.56 | 21.59 | 18.56 | 1.09 |
| 10 | 0.0510 | 0.03 | 5.04 | 2.95 | 19.60 | 16.30 | 1.08 |

Compound 10 is 3-methyl-2-pryazolin-5-one.

| Cmpd | Amount M/M Ag | Dmin | Dmax | Toe Gamma | Mid Gamma | Shldr Gamma | Rel. Speed |
|---|---|---|---|---|---|---|---|
| — | | 0.03 | 4.95 | 3.22 | 15.91 | 7.26 | 1.01 |

-continued

| Cmpd | Amount M/M Ag | Dmin | Dmax | Toe Gamma | Mid Gamma | Shldr Gamma | Rel. Speed |
|---|---|---|---|---|---|---|---|
| 11 | 0.0032 | 0.03 | 5.02 | 3.21 | 15.90 | 9.42 | 1.03 |
| 11 | 0.0064 | 0.03 | 5.10 | 3.24 | 17.17 | 10.71 | 1.06 |
| 11 | 0.0127 | 0.03 | 5.16 | 3.28 | 19.19 | 15.43 | 1.09 |
| 11 | 0.0255 | 0.03 | 5.20 | 3.40 | 19.58 | 14.28 | 1.08 |
| 11 | 0.0510 | 0.03 | 5.25 | 3.52 | 21.61 | 21.73 | 1.09 |

Compound 11 is 3-methyl-3-pyrazolin-5-one

| Cmpd | Amount M/M Ag | Dmin | Dmax | Toe Gamma | Mid Gamma | Shldr Gamma | Rel. Speed |
|---|---|---|---|---|---|---|---|
| — | | 0.02 | 4.88 | 3.07 | 15.56 | 5.51 | 0.99 |
| 12 | 0.0032 | 0.03 | 4.93 | 3.32 | 16.30 | 7.29 | 1.00 |
| 12 | 0.0064 | 0.03 | 4.97 | 3.32 | 16.93 | 8.09 | 1.02 |
| 12 | 0.00127 | 0.02 | 5.08 | 3.41 | 18.33 | 11.20 | 1.04 |
| 12 | 0.0255 | 0.02 | 5.24 | 3.59 | 20.23 | 16.61 | 1.08 |
| 12 | 0.0510 | 0.03 | 5.17 | 3.26 | 20.14 | 20.36 | 1.08 |

Compound 12 is 4-methyl-2-pyrazolin-5-one

The following samples were similarly prepared and exposed. The coatings were developed for 60 seconds at 110 F. in 3M RPD developer.

| Cmpd | Amount M/M Ag | Dmin | Dmax | Toe Gamma | Mid Gamma | Shldr Gamma | Rel. Speed |
|---|---|---|---|---|---|---|---|
| — | | 0.02 | 4.77 | 0.96 | 7.63 | 3.39 | .73 |
| 12 | 0.0510 | 0.03 | 4.94 | 1.10 | 15.13 | 11.72 | .80 |

EXAMPLE 3

The following compounds, some of which are known in the photographic art as having beneficial properties for silver halide emulsions, were evaluated in the same manner as the previous examples but were found not to be effective as contrast promoting agents: 1,2-diacetylhydrazine; napthol; 1,8-naphthalimide; 1-phenyl-3-(2-thiazolyl)-2-thiourea; 1,4,8,11-tetraazacyclotetradecane-5,7-dione; 3*a*,4,5,6-tetrahydrosuccinimido[3,4-b]acenaphthen-10-one; 4,4'-trimethylenebis(1-piperidinecarboxamide); benzoyleneurea {alternate name: 2,4(1H,3H)-quinazolindeione}; 1,5-dihydropyrimido(5,4-d)pyrimidine-2,4,6,8(3H,7H)-tetrone; isatoic anhydride; phthalhydrazide {alternate name: 2,3-dihydro-1,4-phthalazinedione}; 2H-pyrido[3,2-b)-1,4-oxazin-3(4H)-one; barbituric acid; melamine cyanurate; cytosine; 4-5-dihydro-6-methyl-3(2H)-pyridazinone monohydrate; 2,4-dioxohexahydro-1,3,5-triazine; isonicotinamide; methyl-3-pyridylcarbamate; 1-methyluracil; 5-methyl-2-thiouracil; nicotinamide; orotic acid monohydrate {alternate name: 2,6-dioxo-1,2,3,6-tetrahydro-4-pyrimidinecarboxylic acid}; uracil {alternate name: 2,4(1H,3H)-pyrimidinedione}; valerolactam {alternate name: 2-piperidone}; 7,9-dioxo-8-azaspiro(4,5)-decane-6,10-dicarbonitrile; 5-ethyl-5-p-tolylbarbituric acid; 1-(carboxymethyl)pyridinium chloride hydrazide; 1-(3-pyridylmethyl)urea; creatinine; hydantoin; 2-imidazolidone; 2,5-oxazolidinedione; 2-thiohydantoin; 2-thiophenecarboxamide; parabanic acid; (4S,5R)-(+)-1,5-dimethyl-4-phenyl-2-imidazolidinone; ethyl-2-(formylamino)-4-thiazoleacetate; DL-5-(4-hydroxphenyl)-5-phenylhydantoin; (S)-(+)-4-phenyl-2-oxazolidinone; 1-phenyl-3-pyrazolidone; 1-ethyl-2-benzimidazolinone; 5-fluoroisatin; phthalimide; pyromelitic diimide; saccharin {alternate name: o-benzoic sulfimide}; 6-thioxanthine {alternate name: 2-hydroxy-6-mercaptopurine}; xanthine.

The fact that so many photographically useful compounds and other compounds were found to have little or no effect on image contrast is an indication of the uniqueness of the compounds of the present invention.

What is claimed:

1. A negative-acting black-and-white silver halide photographic emulsion comprising a hydrophilic colloid binder, negative-acting silver halide grains, a hydrazine, and a contrast-promoting amount of 3-indazolinone.

2. A negative-acting black-and-white photographic element comprising the emulsion of claim 1 coated on a substrate.

3. The emulsion of claim 1 where said 3-indazolinone is represented by the formula

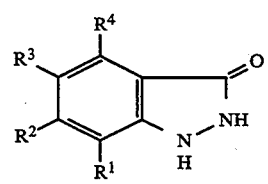

in which $R^1$, $R^2$, $R^3$, and $R^4$ are independently selected from the group consisting of hydrogen, alkyl groups, aryl groups, alkoxyphenyl groups, heterocyclic groups, halogen atoms, carbamyl groups, alkylcarbonyl groups, alkoxycarbonyl groups, and amino groups.

4. The element of claim 2 wherein said 3-indazolinone is represented by the formula

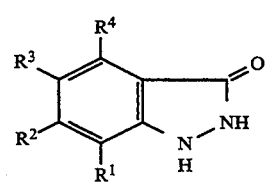

in which $R^1$, $R^2$, $R^3$, and $R^4$ are independently selected from the group consisting of hydrogen, alkyl groups, aryl groups, alkoxyphenyl groups, heterocyclic groups, halogen atoms, carbamyl groups, alkylcarbonyl groups, alkoxycarbonyl groups, and amino groups.

5. The emulsion of claim 1 wherein said hydrazine is represented by the formula $$R^3—NR^4—NR^5—G—X$$

in which:

$R^3$ represents an aryl group, one of $R^4$ and $R^5$ is a hydrogen and the other is selected from hydrogen, aryl sulfonyl and trifluoroacetyl, G represents carbonyl, sulfonyl, sulfoxy, phosphoryl or an imino group and X is a moiety such that at a pH in the range of 9.5 to 12.5 in the presence of an oxidized hydroquinone a cyclization reaction takes place cleaving the moiety —G—X from the remainder of the molecule and forming a cyclic structure comprising atoms of the moiety —G—X.

6. The element of claim 2 wherein said hydrazine is represented by the formula $$R^3—NR^4—NR^5—G—X$$

in which:

$R^3$ represents an aryl group, one of $R^4$ and $R^5$ is a hydrogen and the other is selected from hydrogen, aryl sulfonyl and trifluoroacetyl, G represents carbonyl, sulfonyl, sulfoxy, phosphoryl or an imino group and X is a moiety such that at a pH in the range of 9.5 to 12.5 in the presence of an oxidized hydroquinone a cyclization reaction takes place cleaving the moiety —G—X from the remainder of the molecule and forming a cyclic structure comprising atoms of the moiety —G—X.

7. The emulsion of claim 1 wherein said 3-indazolinone is selected from the group consisting of 3-indazolinone, 5,6-dimethoxy-3-indazolinone, and 6-chloro-3-indazolinone.

8. The element of claim 2 wherein said 3-indazolinone is selected from the group consisting of 3-indazolinone, 5,6-dimethoxy-3-indazolinone, and 6-chloro-3-indazolinone.

9. The element of claim 5 wherein said indazolinone is selected from the group consisting of 3-indazolinone, 5,6-dimethoxy-3-indazolinone, and 6-chloro-3-indazolinone.

10. The element of claim 6 wherein said indazolinone is selected from the group consisting of 3-indazolinone, 5,6-dimethoxy-3-indazolinone, and 6-chloro-3-indazolinone.

11. The emulsion of claim 1 wherein said 3-indazolinone has a central nucleus of the formula:

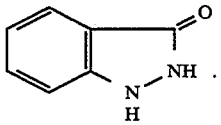

12. The element of claim 2 wherein said 3-indazolinone has a central nucleus of the formula:

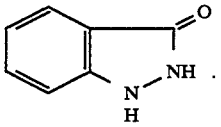

13. The element of claim 2 wherein said 3-indazolinone is selected from the group consisitng of 3-indazolinone, 5,6-dimethoxy-3-indazolinone, and 6-chloro-3-indazolinone.

14. A black-and-white negative-acting silver halide photographic emulsion comprising a hydrophilic colloid binder, negative-acting silver halide grains, a hydrazine, and a contrast-promoting amount of a compound selected from the group consisting of 3-indazolinones, 4(3H)-pyrimidones, urazoles, 2-pyrazolin-5-ones, and 3-pyrazolin-5-ones.

15. A black-and-white, negative-acting photographic element comprising the emulsion of claim 14 coated on a substrate.

16. A high contrast negative-acting black-and-white silver halide photographic emulsion comprising a hydrophilic colloid binder, negative-acting silver halide grains, a hydrazine, and a contrast-promoting amount of 3-indazolinone, wherein said 3-indazolinone is represented by the formula

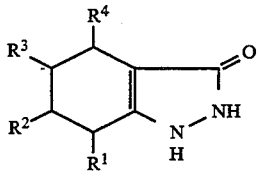

in which $R^1$, $R^2$, $R^3$, and $R^4$ are independently selected from the group consisting of hydrogen, alkyl groups, aryl groups, alkoxyphenyl groups, heterocyclic groups, halogen atoms, carbamyl groups, alkylcarbonyl groups, alkoxycarbonyl groups, and amino groups, and wherein said hydrazine is represented by the formula $$R^3—NR^4—NR^5—G—X$$

in which:

$R^3$ represents an aryl group, one of $R^4$ and $R^5$ is a hydrogen and the other is selected from hydrogen, aryl sulfonyl and trifluoroacetyl, G represents carbonyl, sulfonyl, sulfoxy, phosphoryl or an imino group and X is a moiety such that at a pH in the range of 9.5 to 12.5 in the presence of an oxidized hydroquinone a cyclization reaction takes place cleaving the moiety —G—X from the remainder of the molecule and forming a cyclic structure comprising atoms of the moiety —G—X.

* * * * *